US010767251B2

(12) United States Patent
Takai

(10) Patent No.: US 10,767,251 B2
(45) Date of Patent: Sep. 8, 2020

(54) SPRAY MATERIAL, SPRAYED MEMBER AND MAKING METHOD

(71) Applicant: Shin-Etsu Chemical Co., Ltd., Tokyo (JP)

(72) Inventor: Yasushi Takai, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 16/406,410

(22) Filed: May 8, 2019

(65) Prior Publication Data

US 2019/0352761 A1 Nov. 21, 2019

(30) Foreign Application Priority Data

May 18, 2018 (JP) ..... 2018-095947

(51) Int. Cl.
*C23C 4/11* (2016.01)
*C23C 4/134* (2016.01)

(52) U.S. Cl.
CPC ..... *C23C 4/11* (2016.01); *C23C 4/134* (2016.01)

(58) Field of Classification Search
CPC ..... C23C 4/11; C23C 4/134
USPC ..... 428/696; 427/446
See application file for complete search history.

(56) References Cited

U.S. PATENT DOCUMENTS

| | | | | |
|---|---|---|---|---|
| 6,685,991 | B2 | 2/2004 | Wataya et al. | |
| 6,733,843 | B2 | 5/2004 | Tsukatani et al. | |
| 6,916,534 | B2 * | 7/2005 | Wataya | C01F 17/0043 423/263 |
| 7,462,407 | B2 | 12/2008 | Maeda et al. | |
| 7,655,328 | B2 | 2/2010 | Maeda et al. | |
| 9,388,485 | B2 | 7/2016 | Fukagawa et al. | |
| 2014/0057078 | A1 * | 2/2014 | Hamaya | C09D 5/18 428/148 |
| 2016/0326059 | A1 * | 11/2016 | Nagayama | C04B 35/505 |
| 2017/0370007 | A1 * | 12/2017 | Iguchi | C23C 24/103 |

FOREIGN PATENT DOCUMENTS

| | | | |
|---|---|---|---|
| JP | 2002-80954 | A | 3/2002 |
| JP | 2002-115040 | A | 4/2002 |
| JP | 2004-197181 | A | 7/2004 |
| JP | 2007-308794 | A | 11/2007 |
| JP | 2014-9361 | A | 1/2014 |

* cited by examiner

*Primary Examiner* — Humera N. Sheikh
*Assistant Examiner* — Katherine A Christy
(74) *Attorney, Agent, or Firm* — Westerman, Hattori, Daniels & Adrian, LLP

(57) ABSTRACT

A spray material is defined as composite particles consisting essentially of (A) particles of rare earth fluoride and (B) particles of rare earth oxide, hydroxide or carbonate, consolidated together. The spray material is plasma sprayed onto a substrate to form a sprayed layer containing rare earth oxyfluoride in a consistent manner while minimizing the process shift and releasing few particles. The sprayed member has improved corrosion resistance to halogen-based gas plasma.

20 Claims, 9 Drawing Sheets

SPRAY MATERIAL, SPRAYED MEMBER AND MAKING METHOD

CROSS-REFERENCE TO RELATED APPLICATION

This non-provisional application claims priority under 35 U.S.C. § 119(a) on Patent Application No. 2018-095947 filed in Japan on May 18, 2018, the entire contents of which are hereby incorporated by reference.

TECHNICAL FIELD

This invention relates to a spray material, a sprayed member, and a method for preparing the sprayed member, the sprayed member being suitable as a member to be exposed to a halogen-base gas plasma atmosphere during the etching step in the semiconductor device fabrication process.

BACKGROUND ART

The semiconductor device fabrication process involves the etching step of treating members in a corrosive halogen-base gas plasma atmosphere. Members having sprayed coatings are known to be fully corrosion resistant in such atmosphere. For example, coatings are deposited on the surface of metallic aluminum and ceramic (typically aluminum oxide) substrates by atmospheric plasma spraying of yttrium oxide (Patent Documents 1 and 2) or yttrium fluoride (Patent Documents 3 and 4). Such sprayed members are used in the area of an etching system or etcher which comes in contact with the halogen-base gas plasma. Typical corrosive halogen-base gases used in the semiconductor device fabrication process are fluorine-base gases such as $SF_6$, $CF_4$, $CHF_3$, $ClF_1$ and HF and chlorine-base gases such as $Cl_2$, $BCl_3$ and HCl.

Yttrium oxide-deposited members obtained by plasma spraying of yttrium oxide suffer from few technical problems and have long been utilized as semiconductor-related sprayed members. When yttrium oxide-deposited members are used in the etching step with fluorine gas, there arises the problem that the etching step becomes unstable because outermost surface yttrium oxide can react with a fluoride at the initial of the step, and so the fluorine gas concentration within the etching system changes. This problem is known as "process shift."

To overcome this problem, the replacement by yttrium fluoride-deposited members is under consideration. However, yttrium fluoride tends to have slightly weak corrosion resistance in a halogen-base gas plasma atmosphere, as compared with yttrium oxide. In addition, the yttrium fluoride sprayed coatings have many crevices on their surface and release many particles, as compared with the yttrium oxide sprayed coatings.

Under the circumstances, yttrium oxyfluoride having the characteristics of both to yttrium oxide and yttrium fluoride is regarded attractive as a spray material. Patent Document 5 discloses an attempt to use yttrium oxyfluoride. While yttrium oxyfluoride-deposited members are prepared by atmospheric plasma spraying of a yttrium oxyfluoride spray material, consistent deposition of yttrium oxyfluoride as a sprayed coating is difficult because oxidation gives rise to a compositional shift of fluorine depletion and oxygen enrichment, forming yttrium oxide.

CITATION LIST

Patent Document 1: JP-A 2002-050954 (U.S. Pat. No. 6,733,843)

Patent Document 2: JP-A 2007-308794 (U.S. Pat. No. 7,655,328)

Patent Document 3: JP-A 2002-115040 (U.S. Pat. No. 6,685,991)

Patent Document 4: JP-A 2004-197181 (U.S. Pat. No. 7,462,407)

Patent Document 5: JP-A 2014-009361 (U.S. Pat. No. 9,388,485)

SUMMARY OF INVENTION

An object of the invention is to provide a spray material which ensures consistent deposition of a rare earth oxyfluoride-containing sprayed layer by plasma spraying, the rare earth oxyfluoride-containing sprayed layer being minimized in process shift and particle release as compared with yttrium oxide or yttrium fluoride sprayed layers; a sprayed member formed by plasma spraying; and a method for preparing the sprayed member.

The inventors have found that by using composite particles consisting of particles of rare earth fluoride and particles of rare earth oxide, hydroxide or carbonate, consolidated together as a spray material and plasma spraying the material, a rare earth oxyfluoride-containing sprayed layer is formed in a consistent manner, the sprayed layer having minimal process shift and least particle release; and that a sprayed member having a sprayed layer containing rare earth oxyfluoride as a main phase on a substrate has improved corrosion resistance to halogen-base gas plasma.

In one aspect, the invention provides a spray material comprising composite particles consisting essentially of (A) particles of rare earth fluoride and (B) particles of at least one rare earth compound selected from rare earth oxide, rare earth hydroxide, and rare earth carbonate, consolidated together.

In a preferred embodiment the composite particles consist essentially of 5% to 40% by weight of particles (B) and the balance of particles (A), based on the total weight of particles (A) and (B).

In a preferred embodiment, the spray material contains 0.05% to 3% by weight of an organic binder selected from rare earth organic compounds and organic polymers, based on the total weight of particles (A) and (B).

Also preferably, the spray material has a water content of up to 2% by weight, an average particle size of 10 μm to 60 μm, a specific surface area of 1.5 $m^2/g$ to 5 $m^2/g$, and/or a bulk density of 0.8 $g/cm^3$ to 1.4 $g/cm^3$.

The rare earth element is typically at least one element selected from Y and Group 3 elements from La to Lu.

In another aspect, the invention provides a sprayed member comprising a substrate and a sprayed coating disposed thereon, the sprayed coating including a sprayed layer formed by plasma spraying of the spray material defined above.

In a further aspect, the invention provides a sprayed member comprising a substrate and a sprayed coating disposed thereon, the sprayed coating including an undercoat and a sprayed layer formed by atmospheric plasma spraying of the spray material defined above, the sprayed layer constituting at least an outermost layer.

In a preferred embodiment, the undercoat is composed of a single layer or a plurality of layers, each layer being selected from a rare earth fluoride layer and a rare earth oxide layer.

Preferably, the sprayed layer has a thickness of 150 μm to 350 μm.

Preferably, the sprayed layer contains a rare earth oxyfluoride phase as a main phase and a phase of a rare earth compound other than the rare earth oxyfluoride as an auxiliary phase. Typically, the rare earth oxyfluoride as the main phase is $Re_5O_4F_7$ wherein Re is a rare earth element inclusive of Y. The rare earth compound other than the rare earth oxyfluoride contains both rare earth oxide and rare earth fluoride.

Preferably, the sprayed layer has a volume resistivity at 200° C. and a volume resistivity at 23° C. a ratio of the volume resistivity at 23° C. to the volume resistivity at 200° C. ranging from 0.1 to 30.

Typically, the rare earth element is at least one element selected from Y and Group 3 elements from La to Lu.

In a still further aspect, the invention provides a method for preparing a sprayed member, comprising the step of forming a sprayed layer on a substrate by atmospheric to plasma spraying of the spray material defined herein.

ADVANTAGEOUS EFFECTS OF INVENTION

The spray material of the invention ensures that a rare earth oxyfluoride-containing sprayed layer with minimal process shift and least particle release is formed on a substrate in a consistent manner by plasma spraying. A sprayed member having the sprayed layer has improved corrosion resistance to halogen-base gas plasma.

BRIED DESCRIPTION OF DRAWINGS

DESCRIPTION OF PREFERRED EMBODIMENTS

Figure 1:
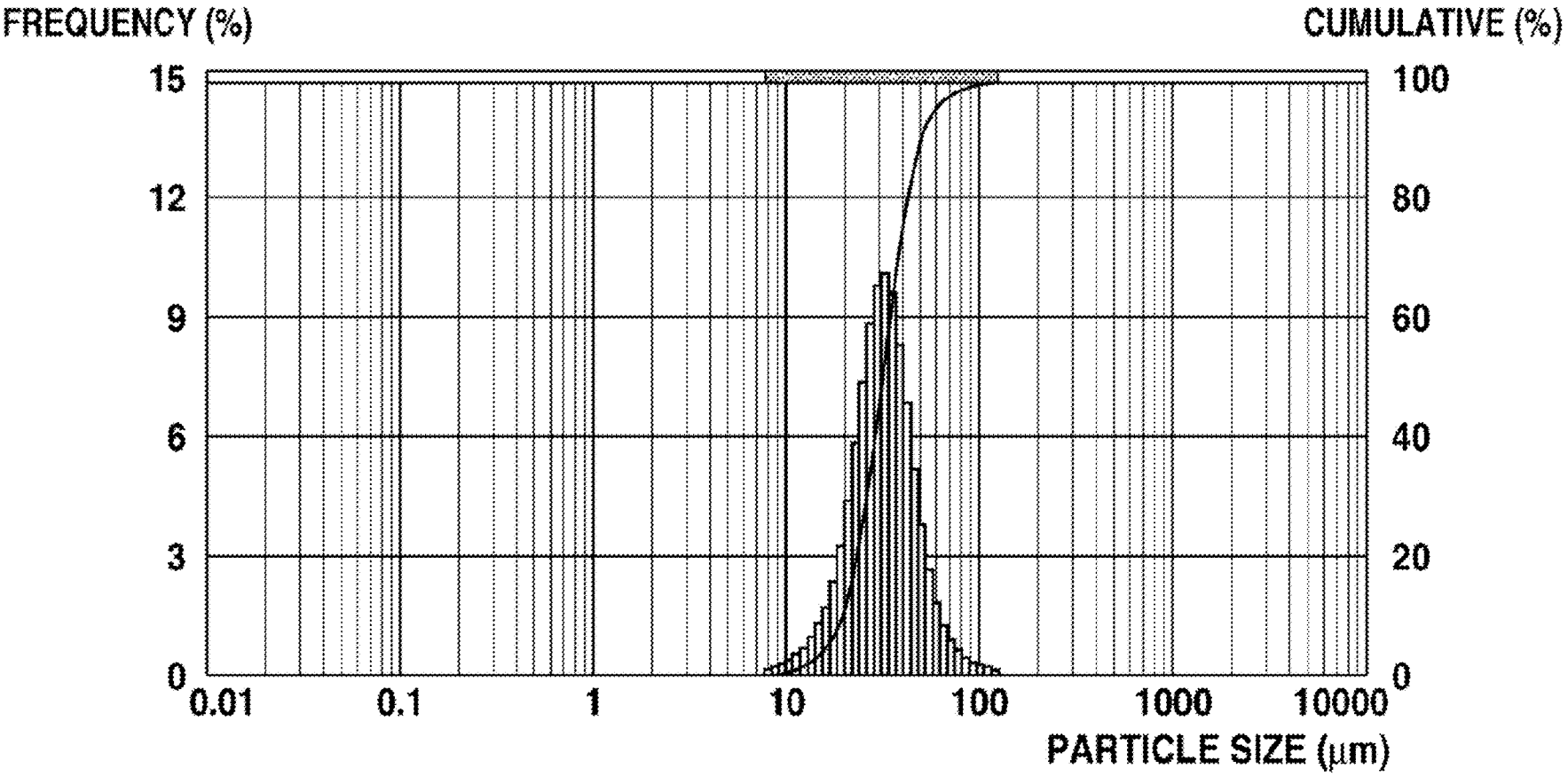
FIG. 1 is a diagram showing a particle size distribution of the spray material obtained in Example 2.

As used herein, the term "sprayed layer" refers to a layer formed of the inventive spray material, whereas the "sprayed coating" encompasses both a coating consisting of a layer of the inventive spray material and a coating consisting of an undercoat and a layer of the inventive spray material. The symbol "Re" is a rare earth element inclusive of Y.

One embodiment of the invention is a spray material comprising composite particles consisting essentially of (A) particles of rare earth fluoride (referred to as particles (A)) and (B) particles of at least one rare earth compound selected from rare earth oxide, rare earth hydroxide, and rare earth carbonate (referred to as particles (B)), consolidated together. The composite particles are a mixture of particles (A) and (B) and may be obtained, for example, by mixing particles (A), particles (B) and optionally other components such as particles (C), organic binder and solvent, optionally compressing and drying the mixture, whereby the particles are consolidated or integrated together in the solid state. After the particles are integrated together, if desired, the product is ground and classified until a powder having a desired average particle size is obtained.

Preferably the composite particles consist essentially of at least 5%, more preferably at least 10% by weight and up to 40%, more preferably up to 25%, especially up to 20% by weight of particles (B) and the balance of particles (A), based on the total weight of particles (A) and (B). The composite particles may contain (C) particles of an inorganic rare earth compound other than particles (A) and (B) as long as the object of the invention is not impaired. Preferably in the composite particles, inorganic rare earth compound particles consist solely of particles (A) and (B).

Particles (A) are particles of rare earth fluoride such as $ReF_3$, which may be prepared by any prior art well-known methods, for example, by mixing a rare earth oxide powder with at least 1.1 equivalents of an acidic ammonium fluoride powder and firing the mixture in an oxygen-free atmosphere such as nitrogen gas atmosphere at 300 to 800° C. for 1 to 10 hours.

Particles (B), which are particles of a rare earth oxide such as $Re_2O_3$, rare earth hydroxide such as $Re(OH)_3$, or rare earth carbonate, and particles (C) may be prepared by any prior art well-known methods. The rare earth carbonate may be a normal salt (normal carbonic salt, specifically $ReCO_3$) or a basic salt (basic carbonic salt, specifically $ReCO_2(OH)$).

The rare earth oxide may be prepared, for example, by preheating an aqueous solution of rare earth nitrate at or above 80° C., adding urea to the solution to form a basic rare earth carbonate (salt), filtering and water washing the salt, and firing the salt in air at 600 to 1,000° C. The rare earth hydroxide may be prepared, for example, by adding an ammonium aqueous solution to an aqueous solution of rare earth nitrate at room temperature to form a rare earth hydroxide, filtering, water washing and drying the hydroxide. The normal rare earth carbonate may be prepared, for example, by adding an ammonium hydrogencarbonate aqueous solution to an aqueous solution of rare earth nitrate at room temperature to form a normal rare earth carbonate, filtering, water washing and drying the salt. The basic rare earth carbonate may be prepared, for example, by preheating an aqueous solution of rare earth nitrate at or above 80° C., adding urea to the solution to form a basic rare earth carbonate (salt), filtering, water washing and drying the salt.

As particles (A), (B) and (C), commercially available powders may be used. Any of particles (A), (B) and (C) may be ground on a jet mill and classified through a pneumatic classifier, for example, yielding a powder of the desired average particle size prior to use. Preferably particles (A), i.e., rare earth fluoride particles have an average particle size of at least 0.1 μm, more preferably at least 0.5 μm and up to 2 μm, more preferably up to 1.5 μm. The particle size distribution of particles is measured by laser light diffractometry, from which particle size D10, D50 (median diameter) or D90 is obtainable. As used herein, the average particle size is a volume basis 50% cumulative particle diameter D50 (median diameter) by laser light diffractometry. Also preferably, the rare earth fluoride particles have a specific surface area of from 1 $m^2/g$ to 30 $m^2/g$ as measured by the BET method.

Also preferably, particles (B), i.e., particles of rare earth oxide, rare earth hydroxide or rare earth carbonate, and particles (C) have an average particle size of at least 0.01 μm, more preferably at least 0.02 μm and up to 1.5 μm, more preferably up to 0.2 μm and a specific surface area of from 1 $m^2/g$ to 30 $m^2/g$ as measured by the BET method.

Preferably, the composite particles contain at least one member selected from rare earth organic compounds and organic polymers as an organic binder. The organic binder preferably acts to intervene between particles to establish a tight bond therebetween. The content of the organic binder is preferably at least 0.05% by weight and up to 3% by weight, especially up to 2.5% by weight based on the total weight of particles (A) and (B) or, preferably, the total weight of particles (A), (B) and (C) if particles (C) are contained. The organic binder is decomposed during plasma spraying, leaving some carbon in the sprayed layer. In this regard, the content of the organic binder is set higher when it is desired that the sprayed layer be more electroconductive, whereas the content of the to organic binder is set lower when it is desired that the sprayed layer be more insulating. Suitable rare earth organic compounds include rare earth carboxylates such as rare earth acetates and rare earth octylates and ketones such as acetylacetonate-rare earth. Suitable organic polymers include polyvinyl pyrrolidone, polyvinyl alcohol (PVA), carboxymethyl cellulose (CMC), and acrylic acid base binders. Of these, water soluble compounds are preferred. For helping particles integrate together, a solvent or liquid such as water or organic solvents may be added in the step of mixing particles.

The composite particles may also be obtained by the granulation method, generally, the method of letting particles of small size coalesce together into particles of large size. One exemplary method is by combining particles (A), particles (B), a solvent (or liquid), and optionally other components (e.g., particles (C) and organic binder), mixing them into a slurry, and spray drying the slurry. Examples of the slurry-forming solvent include water and organic solvents, with water being preferred. The slurry is prepared such that the concentration of the components exclusive of the solvent, i.e. particles (A), particles (B), and optional components (e.g., particles (C) and organic binder) may be 20 to 35% by weight. To the slurry, the organic binder is preferably added in an amount of at least 0.05%, especially at least 0.1% by weight and up to 3%, especially up to 2.5% by weight based on the total weight of particles (A) and (B) or the total weight of particles (A), (B) and (C) if particles (C) are contained.

The spray material in the form of composite particles may contain water originating from the raw materials, particles (A), (B) and (C). When the composite particles are obtained by spray drying of the slurry in water as the solvent, some water may be carried over from the slurry. The spray material preferably has a water content of up to 2% (20,000 ppm) by weight, more preferably up to 1% (10,000 ppm) by weight. Although the spray material can be completely free of water, typically the spray material contains water in a content of at least 0.1% (1,000 ppm) by weight, especially at least 0.3% (3,000 ppm) by weight because of the attribute of composite particles and the method of preparing composite particles.

The spray material (composite particles) preferably has an average particle size of at least 10 μm, more preferably at least 15 μm and up to 60 μm, more preferably up to 45 μm. Also, the spray material (composite particles) preferably has a specific surface area of at least 1.5 $m^2/g$, more preferably at least 2 $m^2/g$, and up to 5 $m^2/g$, more preferably up to 3.5 $m^2/g$ as measured by the BET method. Further, the spray material (composite particles) preferably has a bulk density of up to 1.4 $g/cm^3$, more preferably up to 1.3 $g/cm^3$ and at least 0.7 $g/cm^3$, more preferably at least 0.8 $g/cm^3$.

Of the constituents of which the spray material is composed, the rare earth element is preferably one or more elements selected from Y and Group 3 elements ranging from La to Lu, specifically one or more elements selected from yttrium (Y), samarium (Sm), gadolinium (Gd), dysprosium (Dy), holmium (Ho), erbium (Er), ytterbium (Yb), and lutetium (Lu). More preferably the rare earth element is at least one of yttrium, samarium, gadolinium, dysprosium, and ytterbium. Even more preferably, the rare earth element is yttrium alone, or consists of a major proportion (typically at least 90 mol %) of yttrium and the balance of ytterbium or lutetium.

The spray material is suited for use in plasma spraying, especially atmospheric plasma spraying, i.e., creating a plasma in air atmosphere. When the spray material is plasma sprayed, a sprayed layer containing a main phase of rare earth oxyfluoride is formed in a consistent manner. By using the spray material containing rare earth fluoride and one or more compounds selected from rare earth oxide, rare earth hydroxide, and rare earth carbonate and plasma spraying it, a sprayed layer containing a phase of rare earth oxyfluoride as a main phase is formed as a result of oxidation of rare earth fluoride. With the progress of atmospheric plasma spraying of the spray material, the rare earth compound of which the spray material is composed has an increased oxygen concentration and a decreased fluorine concentration whereby conversion from rare earth fluoride to rare earth oxyfluoride takes place predominantly. For this reason, the inventive spray material is advantageous for forming a sprayed layer containing a main phase of rare earth oxyfluoride.

The inventive spray material, in view of the corrosion resistance and other characteristics of a sprayed layer formed therefrom by plasma spraying, typically atmospheric plasma spraying, is preferably in the state that particles of raw material constituents are mixed, specifically formation of another compound by reaction between raw material constituents has not taken place in a substantial sense. For example, when particles (A) and particles (B) are mixed and heated at high temperature, constituents of particles (A) react with constituents of particles (B) to form a rare earth oxyfluoride from the interface between particles. It is preferred from this point of view that the composite particles (spray material) do not contain rare earth oxyfluorides (e.g., ReOF, $Re_5O_4F_7$, $Re_7O_6F_9$, etc.). The spray material (composite particles) is preferably a simple mixture of particles (A) and (B) wherein the constituents of particles (A) and (B) are maintained substantially unaltered from the state before mixing. For this reason, preferably the spray material has not underwent the thermal history that it is exposed to a temperature of at least 300° C., more preferably at least 180° C. after mixing of particles (A) and (B).

Using the inventive spray material, a sprayed member having a sprayed coating on a substrate may be prepared. Examples of the substrate include aluminum, nickel, chromium, zinc, and alloys thereof, alumina, aluminum nitride, silicon nitride, silicon carbide, and quartz glass for use as members of semiconductor fabrication equipment.

In the practice of the invention, the sprayed coating may be a single layer or consist of a plurality of layers (preferably two or three layers), of which at least one layer is a sprayed layer formed by plasma spraying, preferably atmospheric plasma spraying of the inventive spray material. The sprayed layer preferably has a thickness (of single layer) or a total thickness (of plural layers) of at least 150 μm, more preferably at least 180 μm and up to 350 μm, more preferably up to 320 μm. Where the sprayed coating is a single layer or consists of a plurality of layers, preferably the sprayed layer formed of the inventive spray material provides the outermost layer of the sprayed coating. Differently stated, where the sprayed coating is a single layer, that single layer is preferably the sprayed layer formed of the inventive spray material; and where the sprayed coating consists of plural layers, the layer disposed remotest from the substrate is preferably the sprayed layer thrilled of the inventive spray material.

Where the sprayed coating consists of plural layers, an undercoat may be included as a layer other than the sprayed layer formed of the inventive spray material, typically disposed between the substrate and the sprayed layer of the inventive spray material. The undercoat may be a single layer or consist of a plurality of layers (typically two layer). With respect to the thickness of the undercoat, the single layer or each of plural layers preferably has a thickness of at least 50 μm, more preferably at least 70 μm and up to 250 μm, more preferably up to 150 μm. The total thickness of the undercoat and the sprayed layer is preferably at least 150 μm, more preferably at least 180 μm and up to 500 μm, more preferably up to 350 μm. Each of the layers of the undercoat layer is preferably of rare earth fluoride or rare earth oxide. Such an undercoat may be formed by plasma spraying, typically atmospheric plasma spraying of rare earth fluoride or rare earth oxide.

The plasma gas is preferably a single gas selected from argon, hydrogen, helium and nitrogen gases, or a mixture of two or more thereof. Suitable examples of the plasma gas include, but are not limited to, a four gas mixture of argon/hydrogen/helium/nitrogen, a three gas mixture of argon/hydrogen/nitrogen, a two gas mixture of nitrogen/hydrogen, argon/hydrogen, argon/helium, argon/nitrogen or the like, and a single gas of argon or nitrogen.

The spraying atmosphere, i.e., plasma-surrounding atmosphere is preferably an atmosphere of oxygen-containing gas. Examples of the oxygen-containing gas atmosphere include an oxygen gas atmosphere, and a mixed gas atmosphere of oxygen gas and a rare gas (e.g., argon gas) and/or nitrogen gas. Air atmosphere is typical. The air atmosphere may also be a mixed gas atmosphere of air and a rare gas (e.g., argon gas) and/or nitrogen gas. In the atmospheric plasma spraying, the pressure of the field where plasma is created may be normal pressure or atmospheric pressure, applied pressure, or reduced pressure. In the manufacture of sprayed members for use in semiconductor fabrication equipment, plasma spraying is preferably performed under atmospheric pressure or reduced pressure.

For the plasma spraying, conditions including a spray distance, current value, voltage value, gases, and gas feed rates are not particularly limited. Any prior art well-known conditions may be used. The spraying conditions may be determined as appropriate depending on the identity of substrate, the spray material, a particular application of the resulting sprayed member, and the like. One exemplary spraying procedure involves charging a powder feeder with a powder, i.e., the spray material in the form of composite particles, and conveying the spray material on a carrier gas (e.g., argon gas) to the nozzle of the plasma spray gun through a powder hose. As the spray material is continuously fed into the plasma flame, the spray material is melted and liquefied, forming a liquid flame under the impetus of plasma jet. As the liquid flame impinges against a substrate, the molten spray material is fused, solidified, and deposited thereon. Based on this principle, the sprayed coating (undercoat and sprayed layer) may be deposited on the substrate surface by moving the liquid flame across the substrate surface transversely or vertically by means of an automatic machine (i.e., robot) or manually so as to scan a predetermined region on the substrate surface.

By plasma spraying of the inventive spray material, a sprayed layer is formed on a to substrate, the sprayed layer containing a phase of rare earth oxyfluoride, especially $Re_5O_4F_7$ as a main phase and a phase of rare earth compound other than the rare earth oxyfluoride as an auxiliary phase. In this way, there is prepared a sprayed member comprising a substrate and a sprayed coating thereon including the sprayed layer. The sprayed layer formed by plasma spraying of the inventive spray material may further contain another rare earth oxyfluoride $Re_7O_6F_9$ as an auxiliary phase. The sprayed layer formed by plasma spraying of the inventive spray material may further contain a minor amount of another rare earth oxyfluoride ReOF as an auxiliary phase, although the ReOF-free sprayed layer is preferred. The rare earth compound other than rare earth oxyfluoride is preferably one or both of rare earth oxide and rare earth fluoride, more preferably both rare earth oxide and rare earth fluoride.

The main phase in the sprayed layer formed by plasma spraying of the inventive spray material is a phase to which the highest peak observed on X-ray diffractometry (XRD) analysis of the sprayed layer belongs, and other phases are auxiliary phases. On XRD analysis of the sprayed layer, the intensity of the main peak of the main phase is preferably at least 50%, especially at least 60%, based on the sum of the intensities of the main (highest) peaks of crystal phases of which the sprayed layer is composed. Generally, Cu-Kα line is applied for a characteristic X-ray for the X-ray diffractometry (XRD) analysis.

The sprayed layer formed by plasma spraying of the inventive spray material is as dense as having a porosity of up to 4% by volume, especially up to 2% by volume. Also the sprayed layer is gas hard as having a surface hardness (in Vickers hardness) of at least 270 HV, especially at least 330 HV. Notably, the sprayed layer containing rare earth oxyfluoride as a main phase generally has a surface hardness (in Vickers hardness) of up to 400 HV.

The sprayed layer formed by plasma spraying of the inventive spray material preferably has a volume resistivity at 200° C. of at least $3\times10^{10}$ Ω·cm, especially at least $6\times10^{10}$ Ω·cm, and up to $8\times10^{11}$ Ω·cm, especially up to $3\times10^{11}$ Ω·cm. Provided that the sprayed layer has a volume resistivity at 200° C. and a volume resistivity at 23° C., preferably a ratio of the volume resistivity at 23° C. to the volume resistivity at 200° C. is at least 0.1/1, especially at least 0.5/1 and up to 30/1, especially up to 15/1. The sprayed layer having a volume resistivity at 200° C. and a ratio of the volume resistivity at 23° C. to the volume resistivity at 200° C. in the above ranges is advantageous for use on members in electrostatic chucks and surrounding parts.

Rare earth elements in rare earth oxyfluorides (such as ReOF, $Re_5O_4F_7$, and $Re_7O_6F_9$), rare earth oxides and rare earth fluorides of which the sprayed coating (undercoat layer and sprayed layer) is composed are preferably one or more elements selected from Y and Group 3 elements ranging from La to Lu, specifically one or more elements selected from yttrium (Y), samarium (Sm), gadolinium (Gd), dysprosium (Dy), holmium (Ho), erbium (Er), ytterbium (Yb), and lutetium (Lu). More preferably the rare earth element is at least one of yttrium, samarium, gadolinium, dysprosium, and ytterbium. Even more preferably, the rare earth element is yttrium alone, or consists of a major proportion (typically at least 90 mol %) of yttrium and the balance of ytterbium or lutetium.

EXAMPLE

Examples are given below by way of illustration and not by way of limitation.

Preparation Example 1

Rare earth oxide particles as particles (B) were prepared. Each of three rare earth oxides: $Y_2O_3$, $Gd_2O_3$, and $Dy_2O_3$ shown in Table 1 was prepared by preheating an aqueous solution (0.1 mol/L) of a corresponding rare earth nitrate at 95° C., adding urea to the nitrate solution in an amount of 15 mol per liter of the solution, filtering and water washing the resulting precipitate, firing the precipitate in air at 700° C., grinding the resulting rare earth oxide on a jet mill, and air classifying, thereby collecting rare earth oxide particles having a predetermined particle size. The particle size distribution of the particles was measured by mixing the particles in a 0.1 wt % sodium hexametaphosphate aqueous solution, applying ultrasonic wave at 40 W for 1 minute for dispersion, and analyzing the dispersion by a particle size distribution measuring system (MT3300 by MicrotracBel Corp.) according to laser diffractometry (the same measurement, hereinafter). The average particle size D50 of the particles used in Examples and Comparative Examples is shown in Table 1.

Also, $Sm_2O_3$ particles and $Yb_2O_3$ particles were similarly prepared as the raw material for particles (A) in Preparation Example 2 below.

Preparation Example 2

Rare earth fluoride particles as particles (A) were prepared. Each of four rare earth fluorides: $Y_3$, $YYbF_3$, $GdP_3$, and $SmF_3$ shown in Table 1 was prepared by mixing a corresponding rare earth oxide ($Y_2O_3$, $Yb_2O_3$, $Gd_2O_3$and $Sm_2O_3$) obtained as in Preparation Example 1 with acidic ammonium fluoride ($NH_4HF_2$) powder in a weight ratio of 1:1, firing the mixture in nitrogen gas atmosphere at 650° C. for 4 hours, grinding the resulting rare earth fluoride on a jet mill, and air classifying, thereby collecting rare earth fluoride particles having a predetermined particle size. In Example 8, the ratio of yttrium to ytterbium was Y:Yb=95:5 (molar ratio). The average particle size D50 of the particles used in Examples and Comparative Examples is shown in Table 1.

Preparation Example 3

Rare earth hydroxide particles as particles (B) were prepared. Yttrium hydroxide ($Y(OH)_3$) particles were prepared by adding an ammonium aqueous solution (4 wt %) to an aqueous solution (0.05 mol/L) of yttrium nitrate at room temperature (20° C.) in an amount of 0.1 L per liter of the nitrate solution, filtering and water washing the resulting precipitate, drying the precipitate at 70° C. grinding the resulting yttrium hydroxide on a jet mill, and air classifying, thereby collecting yttrium hydroxide particles having a predetermined particle size. The average particle size D50 of the particles used in Examples is shoe in Table 1.

Preparation Example 4

Basic yttrium carbonate particles as particles (B) were prepared. Basic yttrium carbonate ($YCO_2OH$) particles were prepared by preheating an aqueous solution (0.1 mol/L) of yttrium nitrate at 95° C., adding urea to the nitrate solution in an amount of 15 mol per liter of the solution, filtering and water washing the resulting precipitate, drying the precipitate at 70° C., winding the resulting basic yttrium carbonate on a jet mill, and air classifying, thereby collecting basic yttrium carbonate particles having a predetermined particle size. The average particle size D50 of the particles used in Examples is shown in Table 1.

Preparation Example 5

Normal yttrium carbonate particles as particles (B) were prepared. Normal yttrium carbonate ($Y_2(CO_3)_3$) particles were prepared by adding an aqueous solution (1 mol/L) of ammonium hydrogencarbonate to an aqueous solution (0.05 mol/L) of yttrium nitrate at room temperature (20° C.) in an amount of 0.2 L per liter of the nitrate solution, filtering and water washing the resulting precipitate, drying the precipitate at 110° C., grinding the resulting normal yttrium carbonate on a jet mill, and air classifying, thereby collecting normal yttrium carbonate particles having a predetermined particle size. The average particle size D50 of the particles used in Examples is shown in Table 1.

Examples 1 to 10

A slurry was prepared by using particles (A) in Preparation Example 2 and particles (B) in Preparation Examples 1.3 to 5 in the ratio shown in Table 1 in a total amount of 5 kg, adding the particles to water so as to give a total concentration of particles (A) and (B) of 20 to 30% by weight, adding an organic binder in a ratio of the binder to the sum of particles (A) and (B) shown in Table 1, feeding them into a nylon pot with nylon balls of diameter 15 mm, and milling for about 6 hours. The organic solvent used herein is shown in Table 1 wherein CMC stands for carboxymethyl cellulose, acrylic for acrylic emulsion, and PVA for polyvinyl alcohol. Using a spray dryer (DBP-22 by Ohgawara Kakohki Co., Ltd.), the slurry was granulated into composite particles which were ready for use as a spray material.

Figure 2:
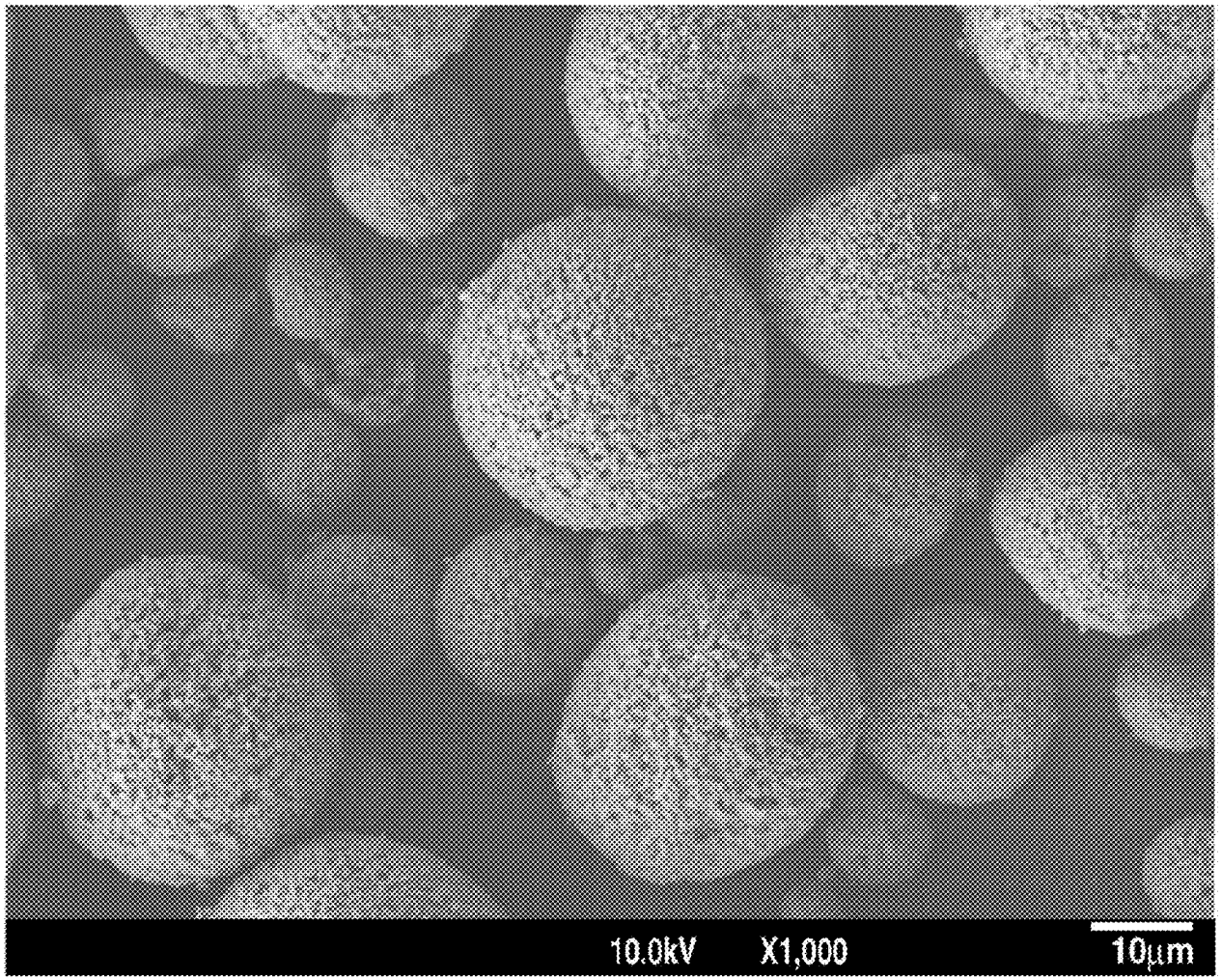
FIG. 2 is an SEM photomicrograph of the spray, material obtained in Example 2.
Figure 3:
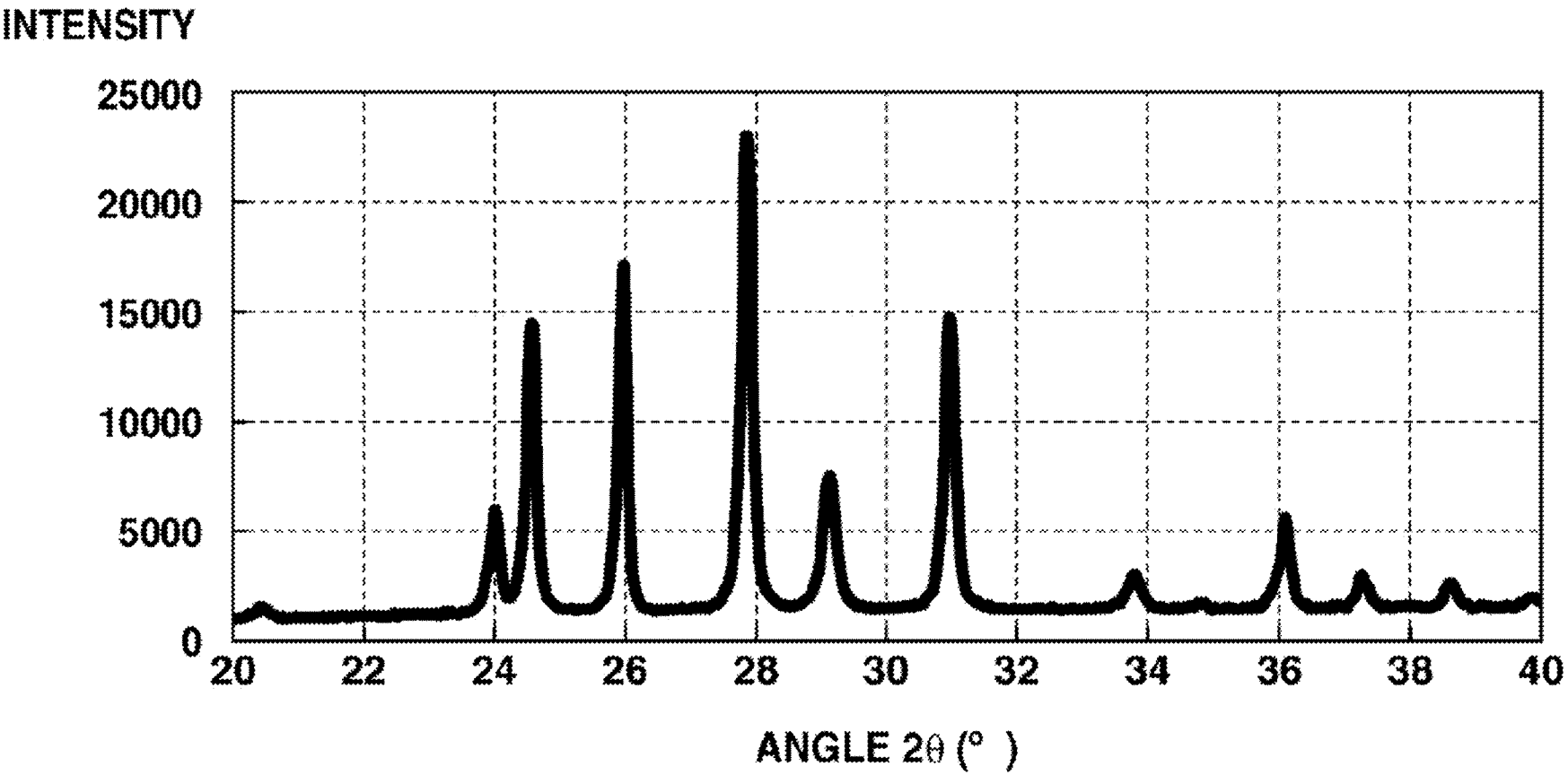
FIG. 3 is a diagram showing a XRD profile of the spray material obtained in Example 2.

The thus obtained particles were evaluated by the following methods. The particle size distribution (D10, average particle size D50, D90) of the particles was measured by a particle size distribution measuring system (MT3300 EXII by MicrotracBel Corp.) in accordance with laser diffractometry. The water content of the particles was measured by a colorimetric moisture meter (model CA200 by Mitsubishi Chemical Analytech Co., Ltd.) in accordance with the Karl Fischer titration. The carbon concentration of the particles was measured by a sulfur-carbon analyzer (SC-632 by LECA Corp.) in accordance with the combustion infrared absorption method. The BET specific surface area of the particles was measured by a full automatic surface area analyzer (Macsorb HM model-1280 by Mountech Co., Ltd.). The particles were analyzed for crystalline phase by an XRD analyzer (X-Part Pro MPD, Cu-Kα line, by Panalytical Ltd.). The bulk density of the particles was measured by a powder tester (PT-X by Hosokawa Micron Co., Ltd.) in accordance with the JIS method. The granule strength of the particles was measured by a micro-compression tester (MCTM-500PC by Shimadzu Corp.). The results of evaluation are shown in Table 2. FIGS. 1, 2 and 3 show a particle size distribution, a photomicrograph (image observed under SEM), and an x-ray diffraction profile of the spray material obtained in Example 2, respectively.

In the diagram of FIG. 3 relating to the spray material obtained in Example 2, peaks at a diffraction angle 2θ of near 20.5°, near 29.2° (main peak), and near 33.8°, indicative of $Y_2O_3$, and peaks at a diffraction angle 2θ of near 24.1°, near 24.6°, near 26.0°, near 27.9° (main peak), near 31.0° , and near 36.1°, indicative of $YF_3$, were detected. That is, the is spray material of Example 2 contained $YF_3$ and $Y_2O_3$. No peaks indicative of rare earth oxyfluoride were detected. In the spray materials of Examples 1 and 3 to 10, peaks indicative of rare earth fluoride and rare earth oxide were detected whereas no peaks indicative of rare earth oxyfluoride were detected.

Comparative Example 1

A slurry was prepared by adding 5 kg of particles (A) in Preparation Example 2 alone to water so as to give a concentration of 30% by weight, adding an organic binder shown in Table 1 in a ratio of the binder to particles (A) shown in Table 1, feeding them into a nylon pot with nylon balls of diameter 15 mm, and milling for about 6 hours. The slurry was granulated through a spray dryer and the granules were fired in nitrogen gas atmosphere at 800° C. for 4 hours, obtaining a spray material. The particles were evaluated by the same methods as in Examples. The results of evaluation are shown in Table 2.

Figure 4:
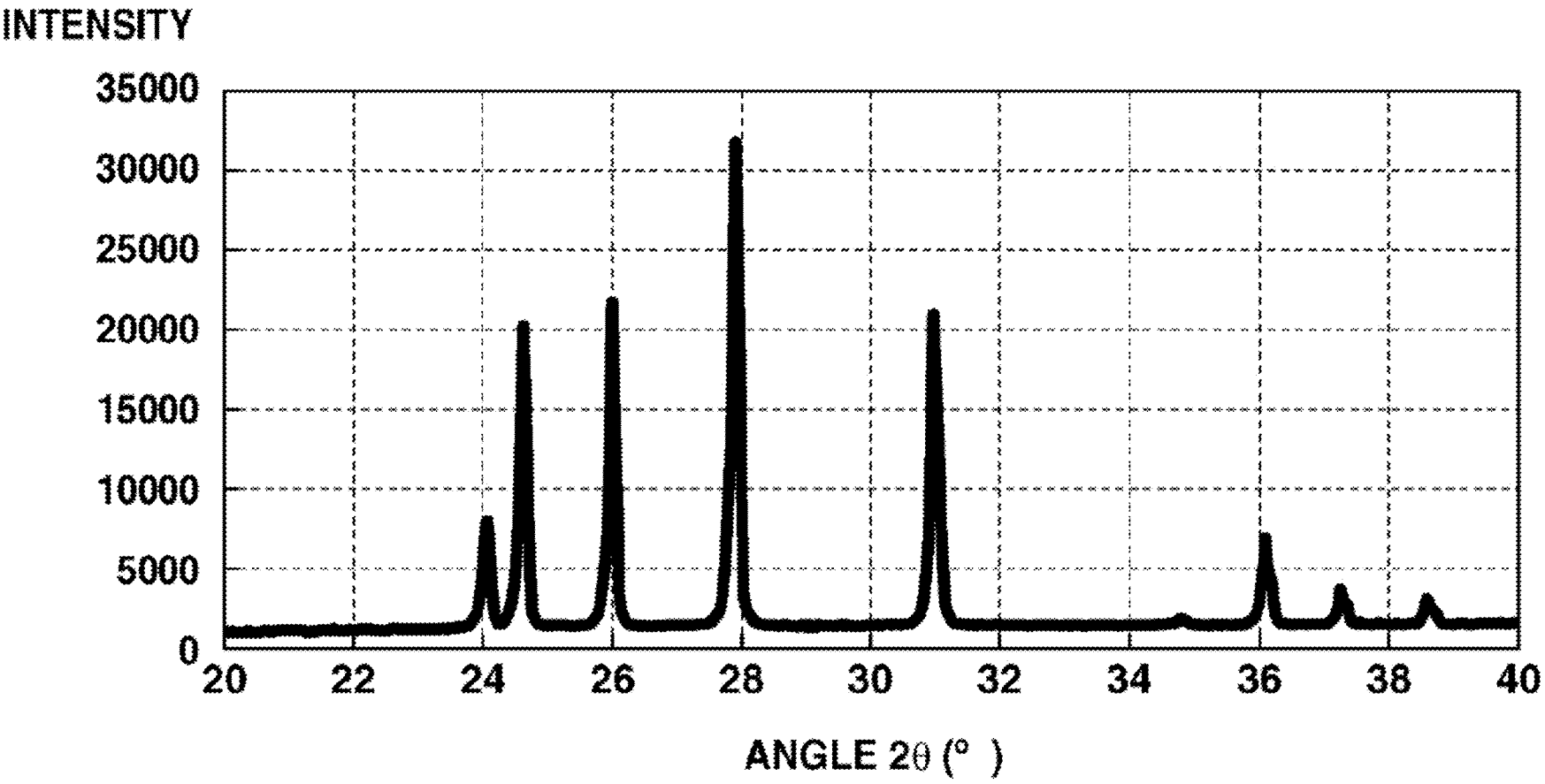
FIG. 4 is a diagram showing a XRD profile of the spray material obtained in Comparative Example 1.

FIG. 4 shows an x-ray diffraction profile of the spray material. In the diagram of FIG. 4, peaks at a diffraction angle 2θ of near 24.1°, near 24.6°, near 26.0°, near 27.9° (main peak), near 31.0°, and near 36.1°, indicative of $YF_3$, were detected. That is, the spray material of Comparative Example 1 contained $YF_3$. No peaks attributable to $Y_2O_3$ were detected. Also no peaks attributable to yttrium oxyfluoride were detected.

Comparative Examples 2 and 3

A slurry was prepared by using particles (A) in Preparation Example 2 and particles (B) in Preparation Example 1 in the ratio shown in Table 1 in a total amount of 5 kg, adding the particles to water so as to give a total concentration of particles (A) and (B) of 30% by weight, adding an organic binder shown in Table 1 in a ratio of the binder to the sum of particles (A) and (B) shown in Table 1, feeding them into a nylon pot with nylon balls of diameter 15 mm, and milling for about 6 hours. The slurry was granulated through a spray dryer and the granules were fired in nitrogen gas atmosphere at 800° C. for 4 hours, obtaining a spray material. The particles were evaluated by the same methods as in Examples. The results of evaluation are shown in Table 2.

Figure 5:
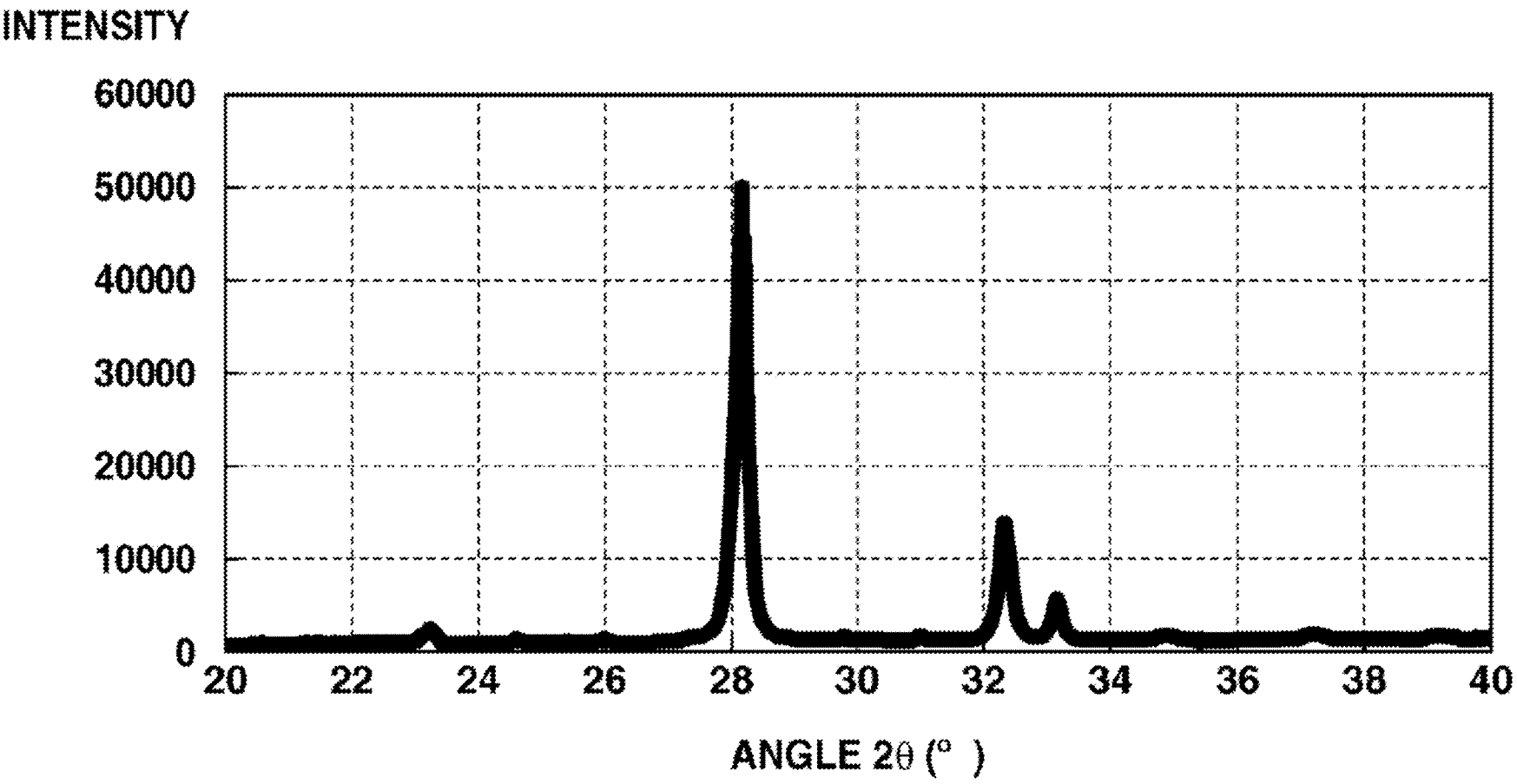
FIG. 5 is a diagram showing a XRD profile of the spray material obtained in Comparative Example 2.

FIG. 5 shows an x-ray diffraction profile of the spray material in Comparative Example 2. In the diagram of FIG. 5, peaks at a diffraction angle 2θ of near 23.2°, near 28.1° (main peak), near 32.2°, and near 33.1°, indicative of $Y_5O_4F_7$, were detected. That is, the spray material of Comparative Example 2 contained $Y_5O_4F_7$. No peaks attributable to $YF_3$ and $Y_2O_3$ were detected. Also for the spray material in Comparative Example 3, the peaks attributable to $Y_5O_4F_7$ were detected whereas no peaks attributable to $Y_3$ and $Y_2O_3$ were detected.

TABLE 1

| | | Particles (A) | | Particles (B) | | Particle ratio (weight ratio) | | Organic binder | |
|---|---|---|---|---|---|---|---|---|---|
| | | Type | D50 (μm) | Type | D50 (μm) | (A) | (B) | Type | Amount (wt %) |
| Example | 1 | $YF_3$ | 0.7 | $Y_2O_3$ | 0.05 | 93 | 7 | CMC | 0.12 |
| | 2 | $YF_3$ | 1.1 | $Y_2O_3$ | 0.1 | 90 | 10 | acrylic | 2.50 |
| | 3 | $YF_3$ | 1.2 | $Y_2O_3$ | 0.1 | 85 | 15 | CMC | 0.25 |
| | 4 | $YF_3$ | 0.5 | $YCO_2OH$ | 0.05 | 92 | 8 | PVA | 0.20 |
| | 5 | $YF_3$ | 1.1 | $YCO_2OH$ | 0.1 | 75 | 25 | acrylic | 2.00 |
| | 6 | $YF_3$ | 0.7 | $Y(OH)_3$ | 0.2 | 93 | 7 | PVA | 1.00 |
| | 7 | $YF_3$ | 1.1 | $Y(OH)_3$ | 0.5 | 70 | 2.5 | CMC | 0.60 |
| | 8 | $YYbF_3$ | 0.9 | $Y_2(CO3)_3$ | 1.5 | 83 | 17 | acrylic | 1.50 |
| | 9 | $GdF_3$ | 1.5 | $Gd_2O_3$ | 0.05 | 85 | 15 | CMC | 0.80 |
| | 10 | $SmF_3$ | 1.0 | $Dy_2O_3$ | 0.01 | 92 | 8 | CMC | 1.20 |
| Comparative Example | 1 | $YF_3$ | 1.3 | — | — | 100 | — | PVA | 0.25 |
| | 2 | $YF_3$ | 1.2 | $Y_2O_3$ | 0.06 | 50 | 50 | CMC | 0.25 |
| | 3 | $YF_3$ | 1.2 | $Y_2O_3$ | 0.06 | 33 | 67 | CMC | 0.25 |

TABLE 2

| | | Particle size distribution | | | Water content | C concentration | BET surface area | | Bulk density | Granule strength |
|---|---|---|---|---|---|---|---|---|---|---|
| | | D10 | D50 | D90 | (ppm) | (ppm) | ($m^2/g$) | XRD crystal phase | ($g/cm^3$) | (MPa) |
| Example | 1 | 11 | 18 | 32 | 2,000 | 800 | 2.1 | fluoride, oxide | 1.3 | <5 |
| | 2 | 19 | 32 | 50 | 10,000 | 20,000 | 4.7 | fluoride, oxide | 1.2 | <5 |
| | 3 | 32 | 46 | 74 | 3,000 | 1,500 | 3.2 | fluoride, oxide | 1.0 | <5 |
| | 4 | 11 | 19 | 32 | 2,000 | 1,500 | 2.1 | fluoride, basic carbonate | 0.9 | <5 |
| | 5 | 19 | 30 | 48 | 9,000 | 15,000 | 4.3 | fluoride, basic carbonate | 0.8 | <5 |

TABLE 2-continued

| | | Particle size distribution | | | Water content | C concentration | BET surface area | | Bulk density | Granule strength |
|---|---|---|---|---|---|---|---|---|---|---|
| | | D10 | D50 | D90 | (ppm) | (ppm) | ($m^2/g$) | XRD crystal phase | ($g/cm^3$) | (MPa) |
| | 6 | 12 | 20 | 33 | 7,000 | 8,000 | 3.3 | fluoride, hydroxide | 0.7 | <5 |
| | 7 | 30 | 45 | 73 | 4,000 | 4,500 | 3.1 | fluoride, hydroxide | 1.0 | <5 |
| | 8 | 25 | 38 | 60 | 6,000 | 12,000 | 3.8 | fluoride, normal carbonate | 0.8 | <5 |
| | 9 | 23 | 34 | 53 | 4,500 | 6,500 | 3.5 | fluoride, oxide | 1.3 | <5 |
| | 10 | 20 | 28 | 40 | 3,000 | 8,000 | 3.6 | fluoride, oxide | 1.3 | <5 |
| Comparative | 1 | 18 | 32 | 50 | <100 | <100 | 1.2 | fluoride | 1.7 | 15 |
| Example | 2 | 33 | 47 | 72 | <100 | <100 | 0.7 | oxyfluoride | 1.6 | 8 |
| | 3 | 24 | 41 | 69 | <100 | <100 | 0.9 | oxyfluoride | 1.5 | 5 |

Formation of Sprayed Coating and Preparation of Sprayed Member

One surface of an aluminum alloy (A6061) substrate of 100 mm squares and 5 mm thick was roughened with corundum abrasive gains. After the roughening treatment, in Examples 1 to 10, an undercoat of single or two-layer structure was formed on the substrate surface to a thickness as shown in Table 3, by plasma spraying under atmospheric pressure, using a spray equipment F4 (Operlikon Metco AG) and an undercoating material shown in Table 3. Next, a sprayed layer was formed on the substrate surface or undercoat to a thickness as shown in Table 3, by plasma spraying under atmospheric pressure, using the spray equipment F4 and each of the spray materials of Examples 1 to 10 and Comparative Examples 1 to 3. That is, a sprayed coating consisting of the undercoat and the sprayed layer formed of the spray material of Examples 1 to 10 or a sprayed coating consisting solely of the sprayed layer formed of the spray material of Comparative Examples 1 to 3 was formed, obtaining a sprayed member. The spraying conditions for both the undercoat and the sprayed layer included plasma applied power (spraying power) of 40 kW, and plasma gas flow rates: ~35 L/min of argon gas and 6 L/min of hydrogen gas.

Evaluation of Sprayed Coating (Sprayed Layer)

Figure 6B:
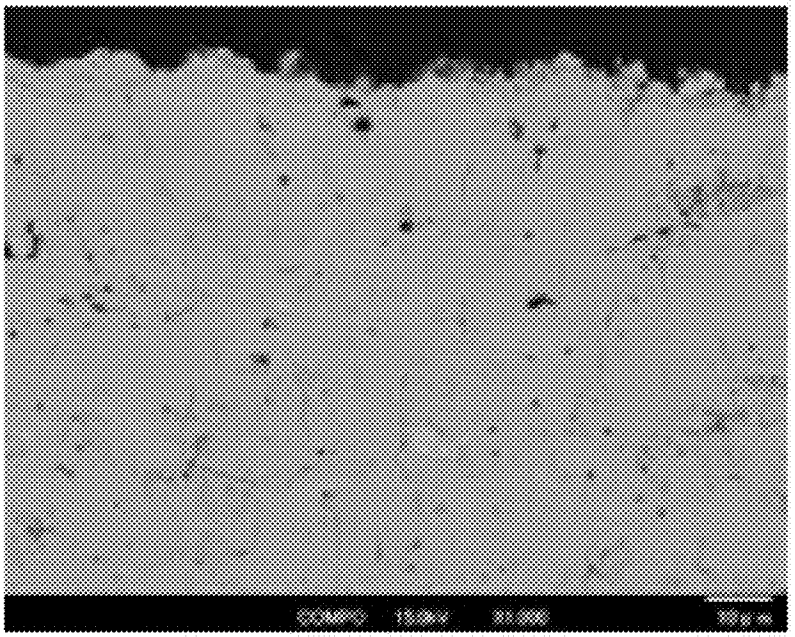
FIGS. 6A and 6B are, respectively, reflection electron composition images used for measuring porosity of a sprayed layer formed from the spray material of Example 2.
Figure 6A:
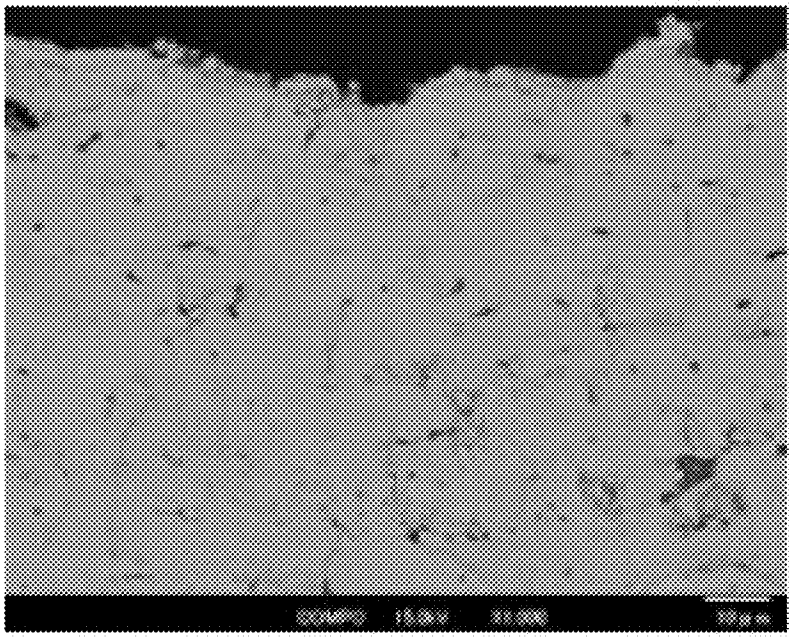

The sprayed coating was evaluated by the following methods. The surface hardness of the sprayed coating was measured by a Vickers hardness tester AVK-C1 (Mitutoyo Corp.). The sprayed layer in the sprayed coating was analyzed for oxygen concentration by an inert gas fusion infrared absorption spectroscopy using an elemental analyzer THC600 (LECO Corp.) and for carbon concentration by the combustion infrared absorption method using a sulfur-carbon analyzer SC-632 (LECO Corp.). The porosity of the sprayed layer was determined by observing and taking images of two view fields of a cross section of the sprayed layer under SEM, performing image analysis, and computing an average value of the two view fields. In particular, the method was in conformity with ASTM E2109, the sprayed layer was embedded into resin to form a sample for SEM, then reflection electron composition images (COMPO images) were taken at magnification ratio of 1,000-power. FIGS. 6A and 6B are two view fields of reflection electron composition images of the sprayed layer in the sprayed coating in Example 2. Pore portions are dark and sprayed coating portions are light gray in the reflection electron composition image. The difference between dark and light in the reflection electron composition image was digitized to a binary image of pore portions and sprayed coating portions with utilizing image analysis software "Section Image" (obtainable through web site), and the porosity was computed as a ratio of the total area of pore portions to the total area of the observed object. The results are shown in Table 3.

TABLE 3

| | | Undercoat (from substrate side) | Sprayed layer (μm) | Hardness (HV) | O concentration (wt %) | C concentration (ppm) | Porosity (vol %) |
|---|---|---|---|---|---|---|---|
| Example | 1 | $Y_2O_3$ 100 μm | 305 | 348 | 2.1 | 140 | 3.0 |
| | 2 | $Y_2O_3$ 70 μm | 210 | 375 | 2.8 | 1,100 | 2.4 |
| | 3 | $Y_2O_3$ 200 μm | 310 | 336 | 3.8 | 250 | 3.2 |
| | 4 | $Y_2O_3$ 100 μm | 250 | 310 | 2.4 | 440 | 2.6 |
| | 5 | $Y_2O_3$ 100 μm | 200 | 362 | 4.5 | 800 | 3.1 |
| | 6 | $Y_2O_3$ 70 μm, $YF_3$ 50 μm | 300 | 340 | 1.8 | 500 | 2.8 |
| | 7 | $Y_2O_3$ 70 μm, $YF_3$ 50 μm | 250 | 295 | 5.5 | 250 | 3.9 |
| | 8 | $Y_2O_3$ 100 μm | 330 | 347 | 3.6 | 300 | 3.7 |
| | 9 | $Gd_2O_3$ 100 μm | 280 | 285 | 2.6 | 350 | 3.2 |
| | 10 | $Y_2O_3$ 100 μm | 250 | 270 | 1.5 | 500 | 3.4 |
| Comparative | 1 | no undercoat | 310 | 210 | 0.3 | <50 | 5.8 |
| Example | 2 | no undercoat | 350 | 265 | 11.8 | <50 | 4.9 |
| | 3 | no undercoat | 210 | 190 | 15.2 | <50 | 5.0 |

Figure 7:
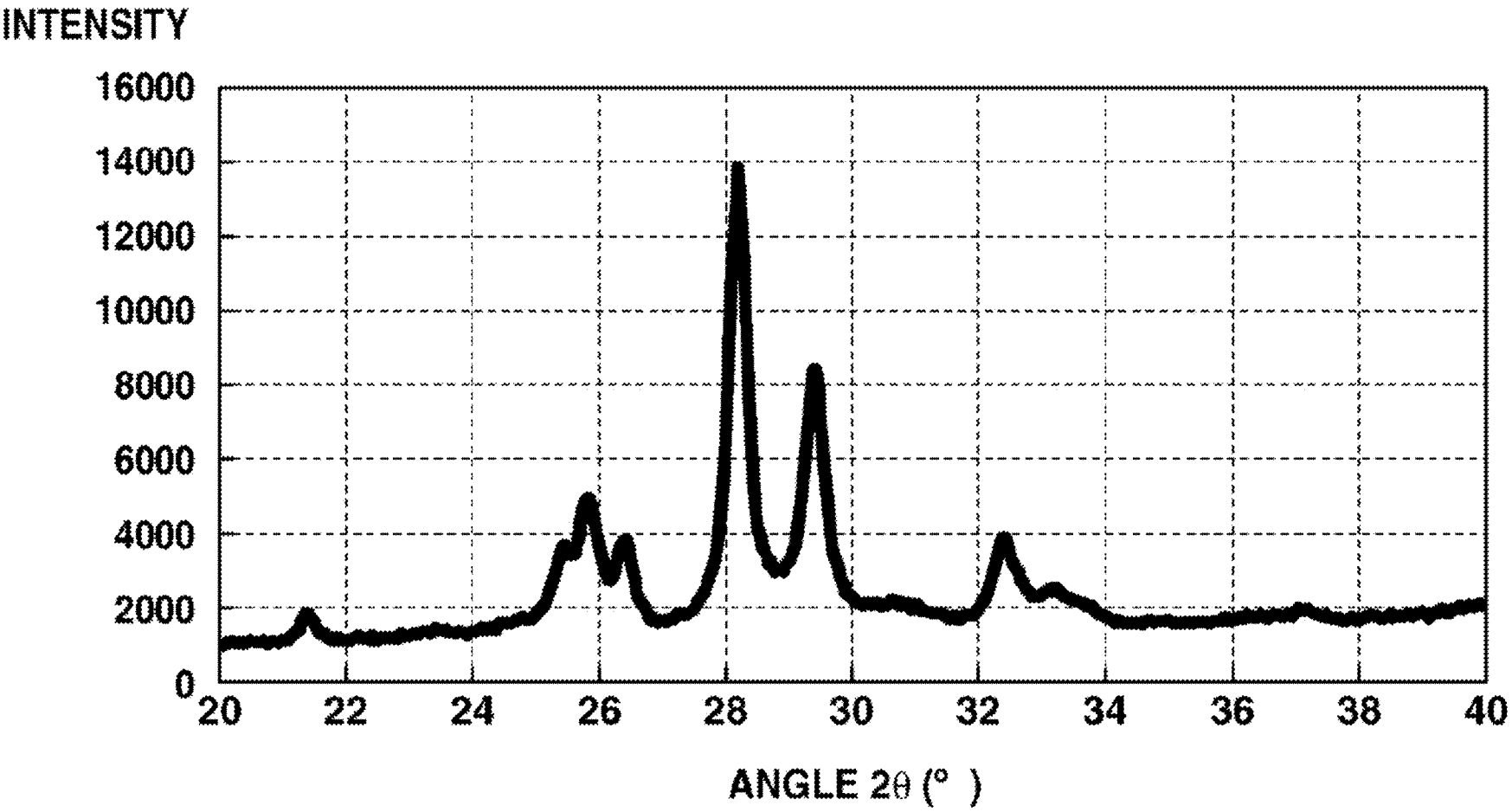
FIG. 7 is a diagram showing a XRD profile of a sprayed layer formed from the spray material of Example 2.
Figure 8:
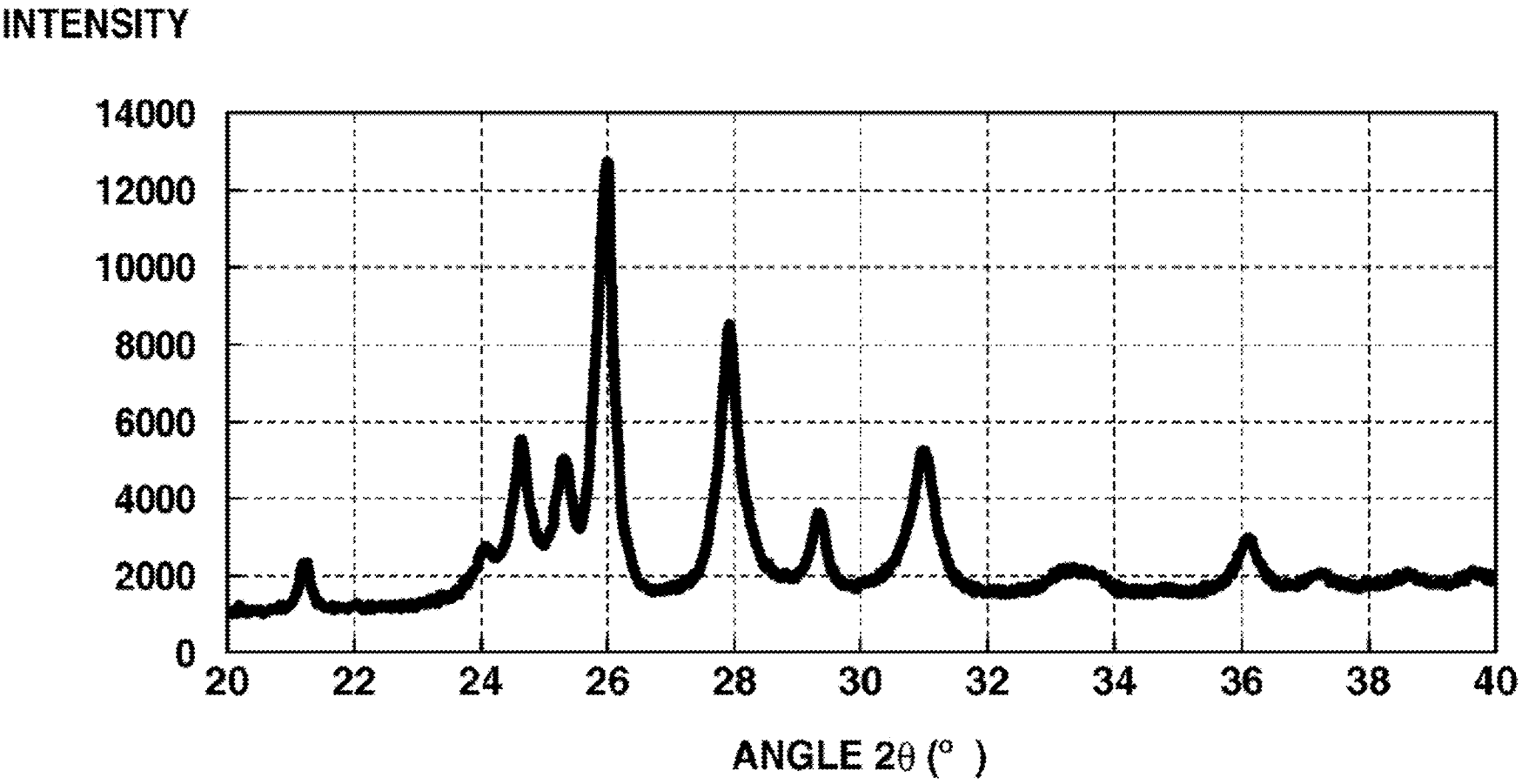
FIG. 8 is a diagram showing a XRD profile of a sprayed layer formed from the spray material of Comparative Example 1.
Figure 9:
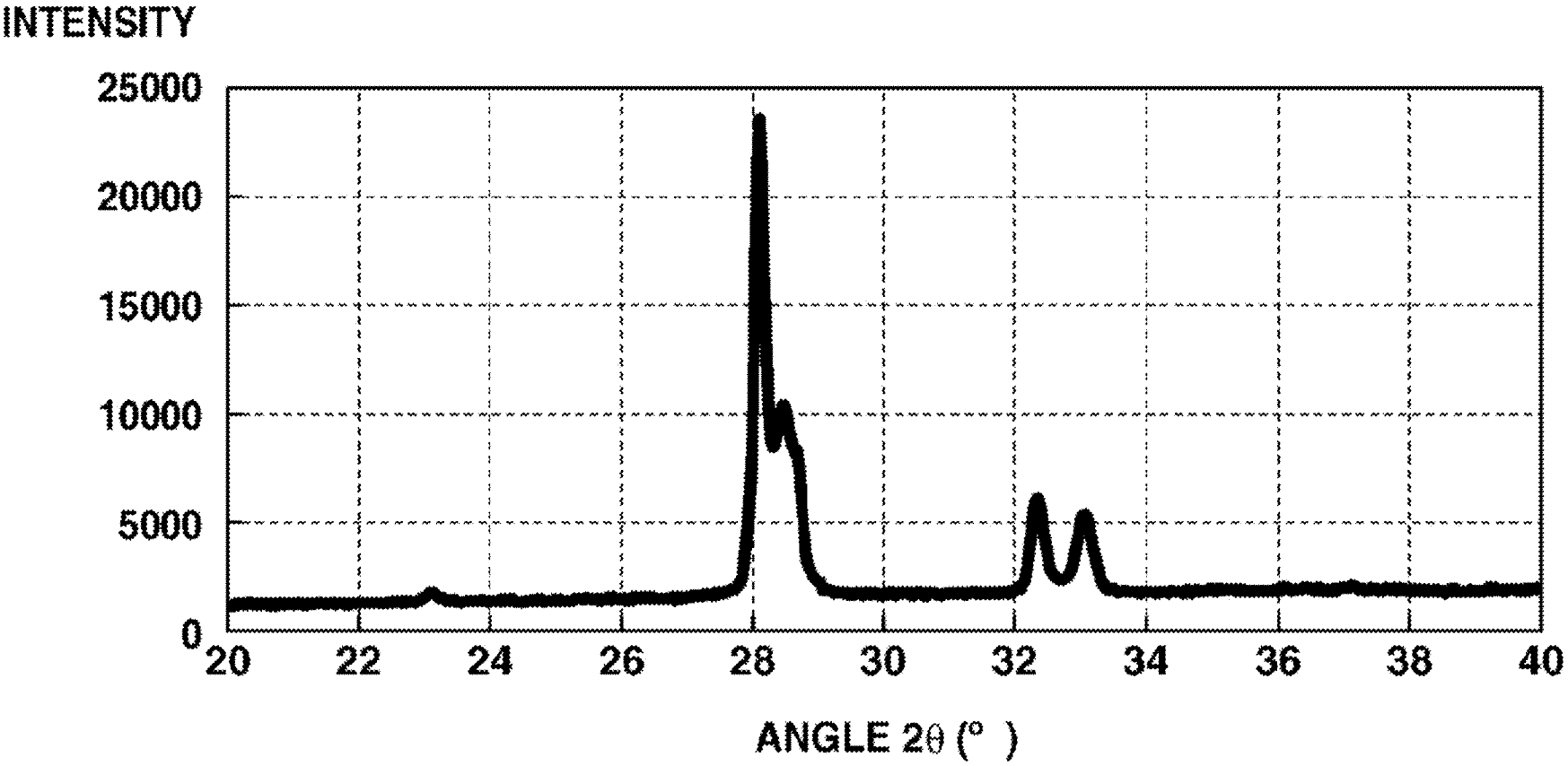
FIG. 9 is a diagram showing a XRD profile of a sprayed layer formed from the spray material of Comparative Example 2.

The outer appearance (color hue) of the sprayed coating was measured by a colorimeter Chroma Meter CR-200 (Konica Minolta Co., Ltd.) on the Lab system (CIE 1976 L*a*b* color space). The sprayed layer in the sprayed coating was analyzed for crystalline phase by scraping the sprayed layer off the sprayed coating, and analyzing by an XRD analyzer (X-Part Pro MPD, Cu-Kα line, by Panalytical Ltd.). The crystalline phase in the sprayed layer was identified, and the main and auxiliary phases were determined from the intensity of their main peak. The volume resistivity of the sprayed coating was measured by a digital ultra-high resistance/micro current meter (model 8340A by ADC Corp.) according to ASTM D257: 2007. Specifically, a volume resistance was measured at 23° C. and 200° C. a volume resistivity was computed from a film thickness, and an average of three measurements was determined. A ratio of the (average) volume resistivity at 23° C. to the (average) volume resistivity at 200° C. was computed. The results of evaluation are shown in Table 4. FIG. 7 is a diagram showing a XRD profile of the sprayed layer in the sprayed coating in Example 2. FIG. 8 is a diagram showing a XRD profile of the sprayed layer in Comparative Example 1. FIG. 9 is a diagram showing a XRD profile of the sprayed layer in Comparative Example 2.

In the diagram of FIG. 7 relating to the sprayed layer in the sprayed coating in Example 2, peaks at a diffraction angle 2θ of near 28.1° (main peak), near 32.2°, and near 33.1°, indicative of $Y_5O_4F_7$, a peak at a diffraction angle 2θ of near 29.2° (main peak), indicative of $Y_2O_3$, and a peak at a diffraction angle 2θ of near 26.0°, indicative of $YF_3$, were detected. That is, the spray material of Example 2 contained $Y_5O_4F_7$ (main phase), $Y_2O_3$ (auxiliary phase) and $YF_3$ (auxiliary phase). For the sprayed layers in the sprayed coatings obtained in Examples 1 and 3 to 10, peaks attributable to rare earth oxyfluoride (main phase), rare earth oxide (auxiliary phase), and rare earth fluoride (auxiliary phase) were detected.

In the diagram of FIG. 8 relating to the sprayed layer in Comparative Example 1, peaks at a diffraction angle 2θ of near 29.2° (main peak) and 33.8°, indicative of $Y_2O_3$, and peaks at a diffraction angle 2θ of near 24.1°, near 24.6°, near 26.0°, near 27.9° (main peak), near 31.0°, and near 36.1°, indicative of $YF_3$, were detected. That is, the sprayed coating of Comparative Example 1 contained $YF_3$ and $Y_2O_3$. No peaks attributable to yttrium oxyfluoride were detected.

In the diagram of FIG. 9 relating to the sprayed layer in Comparative Example 2, peaks at a diffraction angle 2θ of near 23.2°, near 28.1° (main peak), 32.2° and 33.1°, indicative of $Y_5O_4F_7$, and a peak at a diffraction angle 2θ of near 28.7° (main peak), indicative of YOF, were detected. That is, the sprayed coating of Comparative Example 2 contained $Y_5O_4F_7$ and YOF. No peaks indicative of $YF_3$ and $Y_2O_3$ were detected. Further, for the sprayed layer in Comparative Example 3, the peaks indicative of $Y_5O_4F_7$ and YOF were detected whereas no peaks indicative of $YF_3$ and $Y_2O_3$ were detected.

The particle release from the sprayed coating was evaluated by the following method. The method involves the steps of immersing the sprayed member in 1 L of deionized water, applying ultrasonic wave for 60 minutes, pulling up the sprayed member, adding nitric acid to the particle-containing water to dissolve the particles, and measuring the amount of sprayed layer-constituting rare earth elements (Y, Sm, Gd, Dy, Yb) dissolved, by ICP emission spectrometry. The results of evaluation are shown in Table 4. A smaller amount of rare earth element dissolved means less particle release.

The sprayed coating was evaluated for corrosion resistance as follows. The sprayed coating was masked with masking tape to define masked and unmasked (exposed) sections before it was mounted on a reactive ion plasma tester. A plasma corrosion test was performed under conditions: frequency 13.56 MHz, plasma power 1,000 W, etching gas $CF_4$ (80 vol %)+$O_2$ (20 vol %), flow rate 50 sccm, gas pressure 50 mTorr (6.7 Pa), and time 12 hours. After the test, the masking tape was stripped off. Any step formed between the exposed and masked sections due to corrosion was observed under a laser microscope. The step height was measured at 4 points, from which an average was computed to determine a height change as an index of corrosion resistance. The results are shown in Table 4.

TABLE 4

| | | Color hue | | | XRD crystal phase | | Dissoluiton amount | Corrosion resistance | Volume resistivity (Ω · cm) | | Resistivity |
|---|---|---|---|---|---|---|---|---|---|---|---|
| | | L* | a* | b* | Main phase | Auxiliary phase | (mg/L) | (μm) | 23° C. | 200° C. | ratio |
| Example | 1 | 82 | 0.3 | 4.0 | oxyfluoride | fluoride, oxide | 5 | 3 | $2.0 \times 10^{11}$ | $1.0 \times 10^{11}$ | 2.0 |
| | 2 | 43 | 0.9 | 4.0 | oxyfluoride | fluoride, oxide | 3 | 2 | $1.6 \times 10^{12}$ | $1.5 \times 10^{11}$ | 10.7 |
| | 3 | 84 | 1.0 | 3.5 | oxyfluoride | fluoride, oxide | 7 | 4 | $3.6 \times 10^{11}$ | $1.9 \times 10^{11}$ | 1.9 |
| | 4 | 61 | 0.8 | 6.0 | oxyfluoride | fluoride, oxide | 4 | 2 | $6.3 \times 10^{11}$ | $1.4 \times 10^{11}$ | 4.5 |
| | 5 | 49 | 0.9 | 3.8 | oxyfluoride | fluoride, oxide | 8 | 5 | $1.1 \times 10^{12}$ | $2.1 \times 10^{11}$ | 5.2 |
| | 6 | 54 | 0.8 | 5.3 | oxyfluoride | fluoride, oxide | 7 | 4 | $7.1 \times 10^{11}$ | $7.3 \times 10^{10}$ | 9.8 |
| | 7 | 81 | −1.0 | 4.3 | oxyfluoride | fluoride, oxide | 10 | 6 | $3.6 \times 10^{11}$ | $7.3 \times 10^{10}$ | 4.9 |
| | 8 | 78 | −0.3 | 5.3 | oxyfluoride | fluoride, oxide | 8 | 5 | $4.3 \times 10^{11}$ | $8.9 \times 10^{10}$ | 4.8 |
| | 9 | 73 | 1.5 | 1.3 | oxyfluoride | fluoride, oxide | 3 | 2 | $5.0 \times 10^{11}$ | $8.8 \times 10^{10}$ | 5.7 |
| | 10 | 52 | 0.8 | 4.1 | oxyfluoride | fluoride, oxide | 10 | 6 | $7.1 \times 10^{11}$ | $1.4 \times 10^{11}$ | 5.1 |
| Comparative Example | 1 | 93 | 3.5 | 1.5 | fluoride | oxide | 20 | 12 | $5.0 \times 10^{10}$ | $8.0 \times 10^{8}$ | 62.5 |
| | 2 | 95 | 4.5 | −4.0 | oxyfluoride | — | 16 | 10 | $7.0 \times 10^{10}$ | $3.0 \times 10^{8}$ | 233 |
| | 3 | 96 | 4.8 | −5.0 | oxyfluoride | — | 30 | 18 | $7.0 \times 10^{10}$ | $5.0 \times 10^{8}$ | 140 |

In Examples wherein a sprayed layer was formed by atmospheric plasma spraying of a spray material composed of composite particles within the scope of the invention, since rare earth fluoride particles are oxidized to form rare earth oxyfluoride during spraying, the resulting sprayed layer contains rare earth oxyfluoride, rare earth oxide and rare earth fluoride. In those Examples wherein the oxygen concentration originating from the rare earth fluoride in the spray material is 1 to 4% by weight higher than the oxygen concentration calculated from the amounts of raw materials charged in the spray material, i.e., fluoride is oxidized to oxyfluoride with which the sprayed layer is formed, a sprayed layer containing rare earth oxyfluoride as a main phase is obtainable. The sprayed layers of Examples are dense films having a low porosity, a high hardness, and improved corrosion resistance. A XRD profile of a sprayed layer containing rare earth oxyfluoride as a main phase in Examples demonstrates that the rare earth oxyfluoride phase has a small crystal grain size. The finer crystal grains contribute to a higher hardness, and the higher hardness leads to higher corrosion resistance.

Japanese Patent Application No. 2018-095947 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A spray material comprising composite particles comprising (A) particles of rare earth fluoride and (B) particles of at least one rare earth compound selected from rare earth oxide, rare earth hydroxide, and rare earth carbonate, wherein the particles (A) and the particles (B) are consolidated together, wherein a crystal phase of the spray material comprises a first phase corresponding to the rare earth fluoride and a second phase corresponding to the at least one rare earth compound, and wherein the crystal phase of the spray material does not contain a phase corresponding to rare earth oxyfluoride.

2. The spray material of claim 1 wherein the composite particles comprise 5% to 40% by weight of the particles (B) with the balance being the particles (A), based on the total weight of the particles (A) and the particles (B).

3. The spray material of claim 1 further comprising 0.05% to 3% by weight of an organic binder selected from rare earth organic compounds and organic polymers, based on the total weight of the particles (A) and the particles (B).

4. The spray material of claim 1, having a water content of up to 2% by weight.

5. The spray material of claim 1, having an average particle size of 10 μm to 60 μm.

6. The spray material of claim 1, having a specific surface area of 1.5 $m^2/g$ to 5 $m^2/g$.

7. The spray material of claim 1, having a bulk density of 0.8 $g/cm^3$ to 1.4 $g/cm^3$.

8. The spray material of claim 1, wherein a rare earth element in each of the rare earth fluoride, the rare earth oxide, the rare earth hydroxide, and the rare earth carbonate is at least one element selected from Y and Group 3 elements from La to Lu.

9. A sprayed member comprising a substrate and a sprayed coating disposed thereon, the sprayed coating including a sprayed layer formed by plasma spraying of the spray material of claim 1.

10. A sprayed member comprising a substrate and a sprayed coating disposed thereon, the sprayed coating including an undercoat and a sprayed layer formed by atmospheric plasma spraying of the spray material of claim 1, the sprayed layer constituting at least an outermost layer.

11. The sprayed member of claim 10 wherein the undercoat is composed of a single layer or a plurality of layers, each layer being selected from a rare earth fluoride layer and a rare earth oxide layer.

12. The sprayed member of claim 9 wherein the sprayed layer has a thickness of 150 μm to 350 μm.

13. The sprayed member of claim 9 wherein the sprayed layer contains a rare earth oxyfluoride phase as a main phase and a phase of a rare earth compound other than the rare earth oxyfluoride as an auxiliary phase.

14. The sprayed member of claim 13 wherein the rare earth oxyfluoride as the main phase is $Re_5O_4F_7$, and wherein Re is a rare earth element inclusive of Y.

15. The sprayed member of claim 13 wherein the rare earth compound other than the rare earth oxyfluoride contains both rare earth oxide and rare earth fluoride.

16. The sprayed member of claim 9 wherein the sprayed layer has a volume resistivity at 200° C. and a volume resistivity at 23° C., a ratio of the volume resistivity at 23° C. to the volume resistivity at 200° C. ranging from 0.1 to 30.

17. The sprayed member of claim 9 wherein a rare earth element in each of the rare earth fluoride, the rare earth oxide, the rare earth hydroxide, and the rare earth carbonate is at least one element selected from Y and Group 3 elements from La to Lu.

18. A method for preparing a sprayed member, comprising the step of forming a sprayed layer on a substrate by atmospheric plasma spraying of the spray material of claim 1.

19. The spray material of claim 1, wherein the spray material is prepared by mixing the particles (A) and the particles (B) without a heat treatment where the particles (A) and the particles (B) are exposed to a temperature of 180° C. or higher.

20. The spray material of claim 1, having a specific surface area of 2.1 $m^2/g$ to 5 $m_{2/}g$.

* * * * *